US009939114B2

(12) United States Patent
Shiryapov et al.

(10) Patent No.: US 9,939,114 B2
(45) Date of Patent: Apr. 10, 2018

(54) METHOD OF PIPELINE INTERIOR DRYING

(71) Applicant: PUBLICHNOE AKTSIONERNOE OBSCHESTVO "GAZPROM", Moscow (RU)

(72) Inventors: Dmitry Igorevich Shiryapov, Moscow (RU); Sergei Vsevolodovich Karpov, Moscow (RU); Aleksei Sergeevich Alikhashkin, Moscow (RU); Aleksandr Vasilyevich Elfimov, Leninsky r-n Moskovskaya obl. (RU)

(73) Assignee: PUBLICHNOE AKTSIONERNOE OBSCHESTVO "GAZPROM", Moscow (RU)

( * ) Notice: Subject to any disclaimer, the term of this patent is extended or adjusted under 35 U.S.C. 154(b) by 0 days.

(21) Appl. No.: 15/318,621

(22) PCT Filed: Dec. 11, 2014

(86) PCT No.: PCT/RU2014/000930
§ 371 (c)(1),
(2) Date: Feb. 16, 2017

(87) PCT Pub. No.: WO2015/199576
PCT Pub. Date: Dec. 30, 2015

(65) Prior Publication Data

US 2017/0184253 A1 Jun. 29, 2017

(30) Foreign Application Priority Data

Jun. 27, 2014 (RU) ..... 2014126178

(51) Int. Cl.
*F26B 25/22* (2006.01)
*F17D 3/14* (2006.01)
*F26B 21/00* (2006.01)

(52) U.S. Cl.
CPC ..... *F17D 3/14* (2013.01); *F26B 21/006* (2013.01); *F26B 25/22* (2013.01)

(58) Field of Classification Search
CPC ..... F26B 19/00; F26B 21/006; F26B 25/00; F26B 25/22; F17D 3/13; B01D 69/081; B01D 69/10
(Continued)

(56) References Cited

U.S. PATENT DOCUMENTS 2,429,694 A * 10/1947 King ..... G01N 31/222 422/647
2,734,592 A * 2/1956 Jones ..... B01D 53/22 96/8
(Continued)

FOREIGN PATENT DOCUMENTS

| | | |
|---|---|---|
| DE | 3835936 A1 | 4/1990 |
| EP | 0130372 A1 | 1/1985 |
| RU | 2272974 C2 | 3/2006 |

OTHER PUBLICATIONS

International Search Report and Written Opinion of corresponding PCT/RU2014/000930, dated Aug. 25, 2015.

*Primary Examiner* — Stephen M Gravini
(74) *Attorney, Agent, or Firm* — Notaro, Michalos & Zaccaria P.C.

(57) ABSTRACT

Pipeline transport of hydrocarbons detect the moisture accumulation location along the pipeline and increase effectiveness of the drying process. Drying air moisture content reduction is obtained by the installing additional intermediate air drying devices in by-pass lines at block valve station along the pipeline to be dried. Purging is proceeded until normalized dew point temperature value of the outcoming air being achieved. Purging is interrupted for 12 hours or more, both upstream and downstream ends of pipeline leaving hermetically closed, and resumed with intermediate
(Continued)

air drying devices disabled, continuously measuring the moisture content of the outcoming drying air, fixing the moment when the moisture accumulation in the surrounding air.

1 Claim, 1 Drawing Sheet

(58) Field of Classification Search
USPC ..... 34/437; 96/8
See application file for complete search history.

(56) References Cited

U.S. PATENT DOCUMENTS

| | | | | | |
|---|---|---|---|---|---|
| 3,429,186 | A * | 2/1969 | Price | G01N 1/22 | 73/863.61 |
| 4,515,751 | A * | 5/1985 | Krieg, Jr. | G01N 1/22 | 422/501 |
| 4,680,938 | A | 7/1987 | Caley | | |
| 5,093,269 | A * | 3/1992 | Leichnitz | G01N 33/0062 | 422/88 |
| 6,447,573 | B1 * | 9/2002 | Rake | F16N 29/02 | 95/10 |
| 6,830,730 | B2 * | 12/2004 | Rhodes | G01N 31/12 | 422/50 |
| 7,257,990 | B2 * | 8/2007 | Bujas | G01N 15/0826 | 73/38 |
| 9,534,840 | B2 * | 1/2017 | Pahwa | F26B 21/083 | |
| 9,644,891 | B2 * | 5/2017 | Zielinski | F26B 5/04 | |
| 2017/0184253 | A1 * | 6/2017 | Shiryapov | F17D 3/14 | |
| 2017/0341029 | A1 * | 11/2017 | Pigarev | B01D 63/04 | |

* cited by examiner

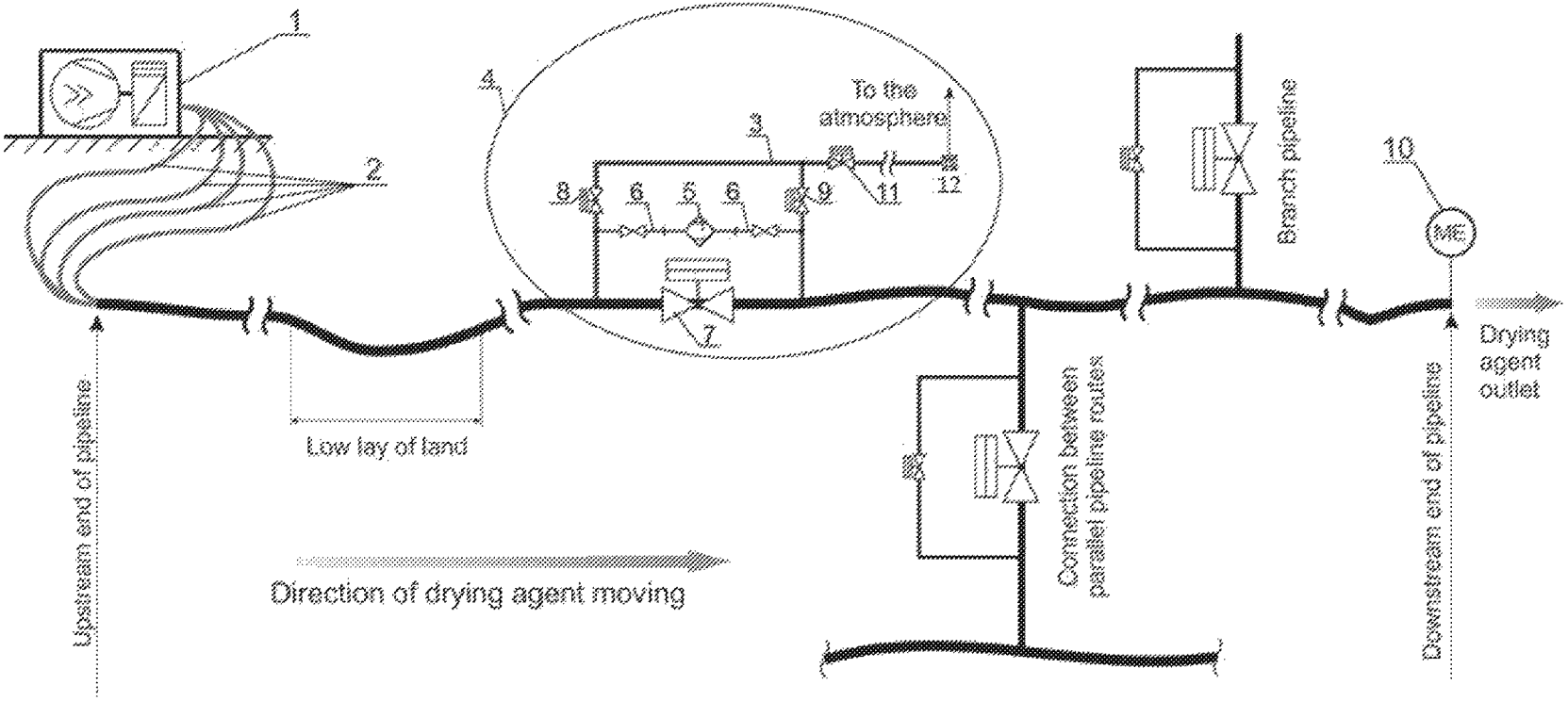
Drying agent outlet
10
Downstream end of pipeline
Branch pipeline
Connection between parallel pipeline routes
To the atmosphere
12
11
9
3
6
5
6
8
7
4
Low lay of land
Direction of drying agent moving
2
1
Upstream end of pipeline

METHOD OF PIPELINE INTERIOR DRYING

The invention herein described and claimed relates to hydrocarbon pipeline transport. The invention can be used during trunk gas pipeline exploitation, maintenance and reconstruction.

Different ways of pipelines' interior dehydration are known. Among them is venting the pipeline with natural gas having dew point temperature not higher than −15° C. at the pressure not less than 2 MPa lower than the level of gas hydrate formation starting at current ground temperature (R 597-86 Recommendations for testing, drying and product filling of natural gas liquids pipelines. Moscow VNIIST, 1986, p. 8). This venting is considered to be completed when the dew point at downstream end of pipeline approaches value between −10° C. and −15° C. The duration of pipeline drying procedure is estimated from period of time needed for pumping via the pipeline quantity of natural gas which is enough to absorb (on the basis of full saturation) water presenting therein in film condition on the inner surface.

The disadvantage of the technique described is using natural gas as a drying agent, which is not economically feasible and does not correspond to the operational safety of gas industry. Thereunto presumption of water film layer being evenly spread within the interior of pipeline along the length and along the perimeter of the pipes, as well as presumption of natural gas 100% moisture saturation in the interior being dried at atmospheric pressure leads to significant increase of the actual pipeline drying duration in comparison with the estimated drying duration. It is also unclear about the way of controlling accuracy of pipeline drying values achievement.

Another pipeline drying technique and the apparatus related thereto (RF patent No 22272974, F26B7/00, published on Mar. 27, 2006) consist of filling the pipeline from atmosphere pressure up to the certain level with drying medium, it's purging and following drying with vacuum. During pressure rising and purging atmospheric air is used as an agent and gaseous media is formed in the pipeline as the mixture of atmospheric air and previously prepared to the predefined moisture inert gas, produced from atmospheric air by means of dividing it in oxygen and nitrogen in the polymeric hollow fiber membranes. After oxygen removal inert gas based on nitrogen is pumped into the pipeline. After exiting the pipeline, inert gas based on nitrogen is separated from the liquid, the liquid is removed, and the dried gas is mixed with the atmospheric air again, divided into oxygen and nitrogen, the water is removed and the inert gas based on nitrogen is injected back into the pipeline, and the further drying process and packing inert gas into the pipeline interior is performed by booster transfer means in the recirculation mode until predetermined values of the environmental humidity and the inert gas concentration in the whole volume of the pipeline to be dried is achieved.

A disadvantage of the known method is that for its implementation it becomes necessary to use complex and bulky equipment, such as injection compressors, vacuum pumps and gas separation module based on hollow fiber membranes. Moreover, the application of nitrogen modules at the initial stage of drying is inefficient due to sharp decrease of effective consumption of a drying agent, since nitrogen modules have a much lower capacity compared to the air drying units (S. V. Karpov et al. Science and technology in the gas industry, 2012, No 4, p. 3).

The closest to the proposed drying method adopted by the applicant as the prototype, is a method of drying pipelines interior (СП 111-34-96 Code of trunk pipelines construction practice. Gas pipelines interior cleaning and testing. Moscow. Gazprom, 1996, p. 44), consisting in purging into the pipeline dry natural gas or air with periodical pigging of the pipeline with inline separation pigs or methanol block limited by at least two separation pigs. The drying process is controlled by measuring the humidity at the downstream end of the pipeline at regular intervals until the desired degree of humidity is achieved. When using methanol it is recommended to choose its volume depending on the length of the pipeline section, the topographical relief and the presumably remaining amount of water in the pipeline.

The disadvantage of this method is that upon drying by dry natural gas or air the indicator at which the drying is considered to be completed (20 grams of water per 1 cubic meter of dry gas in pipeline interior) is not sufficient to prevent hydrates formation, because it is not stated at which pressure the indicated value of moisture content should be registered. The natural gas moisture content of 20 gram per cubic meter at atmospheric pressure corresponds to dew point temperature at water +22.5° C. (Staskevich N. L. and others. Guide on gas-supply and gas use. L.: Nedra, 1990, p. 38), thus the water will be condensated from gas at a lower temperature. Moreover, the described method does not allow to control the quality of drying (confirmation of reached parameter of drying), which reduces the effectiveness of the drying process.

In world and domestic practice of exploitation of pipelines intended to be used for transport of natural gas, high-purity petroleum products, hydrogen sulfide containing products, ammonia and some other products, it is compulsory to avoid presence of water in liquid phase in the pipeline interior as well as to fulfil a requirement of mass moisture content in the pipeline interior before injection of the product into the pipeline. The reason is that hydrocarbon gases upon contact with humid environment form hydrates and that there are requirements of moisture content of transported products. Forming of hydrates in the pipelines interior leads which leads to occurrence of local resistance, partial furring of flow area or even full blockage of flow area.

For the achievement of the above mentioned demands the drying method of pipelines' interior and technological vessels is applied before product filling there into.

Modern long gas pipelines construction technology includes strength testing of build pipeline sections using hydraulic or pneumatic method following by water removal from the pipeline interior by pigging of the pipeline with inline separation pigs (in case hydraulic testing is used) and with liquid saturable urethane-foam resilient pigs. To decrease moisture content in the pipelines interior to the predetermined value and to remove film moisture from the inner surface of the pipelines drying is performed after the strength testing and water removal. Two main drying methods include venting drying by purging by preliminary dried gaseous agent (air, natural gas or nitrogen) to achieve set dew point temperature (required moisture content), as well as vacuum drying based on the reduction of water boiling temperature with the decrease of pressure in the interior being dried and containing water steam evacuation by vacuum pumps until the pressure in the interior being dried corresponds to pressure of saturated water steams at required dew point temperature of air by water.

Venting drying is applied as a rule, for long-distance pipelines, while vacuum drying is preferable for technological vessels having comparably small volume and complicated configuration.

SUMMARY OF THE INVENTION

The principal object of the present invention is to provide a method of drying a pipeline interior to achieve the required moisture content level at the downstream end of pipeline and along the pipeline.

The technical result of the present invention is enhancement of functional capacities, including the possibility to detect the moisture accumulation location along the pipeline as well as to increase effectiveness of drying process thanks to repeated dehydration of the drying agent and drying duration reduction.

BRIEF DESCRIPTION OF THE DRAWING:

In the drawings, FIG. 1 is a schematic representation of a system for drying a mainline pipeline in accordance with the invention.

Above-mentioned technical result is obtained by reducing moisture content in the drying air during purging with the means of air drying devices in the method of drying gas pipeline by purging the pipeline with the drying air, the air drying devices are installed in by-pass lines at block valve stations of the pipeline to be dried. Purging process is being carried out until the normalized value of dew point temperature of drying air of −15° C. . . . −30° C.) is achieved at the downstream end of the pipeline. Next, the purging process is interrupted for the period not less than 12 hours, after which purging is resumed with air drying devices switched off being accompanied with continuous measuring of moisture content in the drying air at the downstream end of the pipeline to be dried. During measuring the timepoint is registered which evidences of the presence of the moisture accumulation where the moisture content in the drying air exceeds the normalized value of the dew point temperature. Then the distance between the moisture accumulation location and upstream end of the pipeline is calculated, water is removed from the pipeline interior being dried at the moisture accumulation locations and purging is accumulation continued until the normalized value of the dew point temperature of the drying air at the downstream end of the pipeline is achieved.

During pipeline drying process the moisture content of drying air increases from incoming value up to the level corresponding 100% saturation, considerably jumping at the border between dried and wet parts of the pipeline. The air goes the following route up to the downstream end of pipeline without water absorption. Installation of the air drying devices at by-pass lines at block valve stations provides reduction of the drying process time in multiples of the number of block valve station along the pipeline.

DESCRIPTION OF THE PREFERRED EMODIMENT:

Layout of the pipeline drying equipment in the mainline pipeline is shown in FIG. 1. The method is executed as following.

Drying unit (1), comprising compressor and air-drying unit, e.g. MDU 7000 by Munters (Sweden), is connected to the upstream end of the mainline pipeline section being dried by flexible hoses (2), connected to flanges at the temporary blind plug (not shown) mounted at the upstream end of the mainline pipeline section being dried. At by-pass lines (3) contained in block valve stations (4) air drying devices (5) are installed and connected to gas extraction risers (6), existing on each block valve station (4). Meanwhile, line valve (7) and by-pass valves (8), (9) are closed, providing air passage through air drying devices (5) only. As air drying devices (5) cold regeneration adsorbers may be used, e.g. Dry Xtreme ND series (production of MTA Group, Italy), which are selected for drying of the specific section of the linear portion of the mainline pipeline, on the basis of throughput capacity of air drying devices (5), inlet and outlet diameters of air dryer and drying unit's capacity. At the downstream end of section of the linear portion of the mainline pipeline to be dried on-stream hygrometer (10) is installed which measures outgoing drying air dew point temperature by water. Next, drying unit (1) is switched on and drying air is passed through the section of the linear portion of the mainline pipeline to be dried. Wherein drying air moves at each of the linear valve stations (4) passes through the air drying device (5), which leads to a reduction of air moisture content, increasing its capability of water absorption at its way after valve station (4) in mainline pipeline interior, which provides reducing drying duration of the whole section to be dried. As the value of the dew point temperature corresponding to the normalized value (−15° C. . . . −30° C.) is achieved at downstream end of section of the linear portion of the mainline pipeline to be dried, pipeline purging process is interrupted for period not less than 12 hours. During above mentioned 12 hours all line valves (7) of the linear valve stations (4) are opened and air drying devices (5) are switched off at the section of the linear portion of the mainline pipeline to be dried, providing drying air to pass along pipeline through line valves (7). After 12 hours (or more) hours purging of the section of the linear portion of the mainline pipeline to be dried is resumed along with simultaneous continuous measurement of the dew point temperature of the drying air at the downstream end of the section of the linear portion of the mainline pipeline to be dried. Continuous measurement of the dew point temperature of the drying is carried out during time ($t_{control}$), required to displace the air contained in the interior of the section of the linear portion of the mainline pipeline to be dried, which is determined using the formula $$t_{control} = \frac{\pi D^2 L_{pipeline}}{4 q_{DrUn}} \tag{1}$$

where D is inner diameter of the section of the linear portion of the mainline pipeline to be dried, meters;

$L_{pipeline}$ is the length of section of the linear portion of the mainline pipeline to be dried, meters;

$q_{DrUn}$ is the capacity of the compressor of the drying unit (1), $m^3$ per min.

If during the time $t_{control}$ dew point temperature at the downstream end of the section of the linear portion of the mainline pipeline to be dried does not exceed the normalized value, purging is stopped and drying of the pipeline is considered to be completed. If the dew point temperature at the downstream end of section of the linear portion of the mainline pipeline to be dried exceeds the normalized value by the value higher than the measurement error of on-stream hygrometer (10), which indicates the presence of a moisture accumulation, than distance from the moisture accumulation to the upstream end of the section of the linear portion of the mainline pipeline to be dried is calculated using the formula $$X_{moist} = L_{pipeline} - \frac{4 t_{ex} q_{DrUn}}{\pi D^2} \tag{2}$$

where $t_{ex}$ (minutes) is the time elapsed since the purging resumption until registering of dew point temperature exceeding the normalized value. Next, the distance obtained is correlated (snapped) with the technological scheme and the profile of the route of the section of the linear portion of the mainline pipeline to be dried and the presumptive reason of the water accumulation occurrence is defined, e.g. low lay of land, connection between parallel pipeline routes or linear valve stations location. If technically feasible, the remaining water is removed from the pipeline interior, for example, by draining through the drainpipe or by pumping out with a pump. Next, the line valve at the linear valve station nearest to the water accumulation along the drying air flow is closed. Purging of the indicated section of the linear portion of the mainline pipeline to be dried is continued. Wherein releasing of the drying air is carried out by opening tap valve (11) through the vent stack (12) of the indicated linear valve station with bypass valve (8) open. If several water accumulations are detected on the section of the linear portion of the mainline pipeline to be dried, closing of line tap valves and the removal of the water are performed sequentially, starting with the accumulation closest to the upstream end of the section of the linear portion of the mainline pipeline to be dried. Next, all the line tap valves are opened and purging is continued until achieving the dew point temperature value at the downstream end of the section to be dried which is below or equal to the normalized value. The pipeline drying process is interrupted for period not less than 12 hours, after if necessary, all operations of the drying process are repeated again, starting from determination of $t_{contr}$ according to formula (1).

The invention herein described was used for Urengoi-Center (outside diameter is 1420 mm, operating pressure is 7.4 MPa) trunk gas pipeline renovation. Pipeline section having length 60 km was previously hydraulically tested. Drying operation was performed by means of Atlas Copco XRX566CD air compressors (capacity is 2000 $m^3$ per hour @ 0.1 MPa) and Atlas Copco CD 520 absorption units (dew point minus 40° C. @ atmospheric pressure). Above mentioned pipeline section was fitted with the valve station located 30 kilometers from drying unit. Intermediate air drying device (Dry Xtreme ND-032, 1962 $m^3$ per hour capacity) was installed at valve station by-pass line. During the pipeline drying process the section from the upstream end of the pipeline up to the valve station and the section from the valve station up to the downstream end of pipeline) were dried simultaneously due to intermediate air dehydration up to the initial moisture content. As a result of the application of the proposed method providing an intermediate dehydration of the drying agent (air), the duration of the pipeline section drying process is 10.3 days, i.e. the said duration is reduced by approximately 1.8 times in comparison with the drying process in according to the commonly known method.

The invention claimed is:

1. Method of drying a mainline pipeline by purging of the pipeline with drying air with subsequent humidity measurement at a downstream end of the pipeline, characterized in that moisture content in the drying air is reduced during purging by means of air drying devices, which are installed at bypass lines of linear valve stations of the pipeline to be dried;

wherein purging is proceeded until normalized value of dew point temperature of the drying air at the downstream end of the pipeline to be dried between minus 15° C. and minus 30° C. is achieved, then purging is interrupted for at least 12 hours;

next, purging of the pipeline to be dried is resumed with the air drying devices switched off, continuously measuring the moisture content in the drying air at the downstream end of the pipeline to be dried, wherein a timepoint which evidences of presence of moisture accumulation where the moisture content in the drying air exceeds the normalized value of the dew point temperature is registered;

then a distance between water accumulation location and a pipeline upstream end of the pipeline to be dried is calculated, water is removed from an interior of the pipeline to be dried at water accumulation locations and purging is of the pipeline to be dried is continued until normalized value of the dew point temperature of the drying air at the downstream end of the pipeline to be dried is achieved.

* * * * *